US005709485A

United States Patent [19]

Kohno

[11] Patent Number: 5,709,485

[45] Date of Patent: Jan. 20, 1998

[54] CARD PRINTER INCLUDING INK RIBBON CARTRIDGE WITH GUIDE SHAFTS

[75] Inventor: Nobuo Kohno, Kanagawa, Japan

[73] Assignee: Sony Corporation, Tokyo, Japan

[21] Appl. No.: 552,867

[22] Filed: Nov. 3, 1995

Related U.S. Application Data

[63] Continuation-in-part of Ser. No. 229,590, Apr. 19, 1994, abandoned.

[51] Int. Cl.[6] ..... B41J 35/28

[52] U.S. Cl. ..... 400/208; 400/248; 347/214

[58] Field of Search ..... 400/120.16, 120.17, 400/120 HE, 207, 208, 208.1, 248, 248.1, 248.2, 250; 347/197, 214, 215, 217, 218, 221

[56] References Cited

U.S. PATENT DOCUMENTS

| | | | |
|---|---|---|---|
| 5,080,512 | 1/1992 | Schofield et al. | 400/223 |
| 5,135,319 | 8/1992 | Kobayashi et al. | 400/208 |
| 5,466,076 | 11/1995 | Kobayashi et al. | 400/248 |

FOREIGN PATENT DOCUMENTS

| | | | |
|---|---|---|---|
| 55-055882 | 4/1980 | Japan | 400/248 |
| 56-120386 | 9/1981 | Japan | 400/208 |
| 61-016876 | 1/1986 | Japan | 400/248 |
| 63-091274 | 4/1988 | Japan | 400/248 |
| 1-290465 | 11/1989 | Japan | 400/208 |
| 2-006176 | 1/1990 | Japan | 400/208 |
| 3-083682 | 4/1991 | Japan | 400/248 |
| 3-150182 | 6/1991 | Japan | 400/208 |
| 4-053786 | 2/1992 | Japan | 400/248.1 |
| 4-251780 | 9/1992 | Japan | 400/208 |
| 4-371880 | 12/1992 | Japan | 400/208 |

*Primary Examiner*—David A. Wiecking
*Attorney, Agent, or Firm*—Jay H. Maioli

[57] ABSTRACT

A compact ink ribbon cartridge includes a casing divided into lower and upper halves and rotatably mounts ink ribbon supply and take-up reels in a parallel spaced apart relationship. A length of ink ribbon is wound between the reels so as to be stretched over a head insertion opening provided through the cartridge casing. A guide portion is provided at a central portion of the cartridge casing such that ink ribbon guide shafts are disposed at both sides of the head insertion opening along the path of winding of the ink ribbon. A plurality of guide shafts are provided at each side of the head insertion opening as necessary for prevention of wrinkling and/or slackening of the ink ribbon. Furthermore, the print head of a printer is provided with guide shafts to guide the ink ribbon and to minimize the vertical distance that the print head must travel.

16 Claims, 8 Drawing Sheets

CARD PRINTER INCLUDING INK RIBBON CARTRIDGE WITH GUIDE SHAFTS

This application is a continuation-in-part of U.S. Ser. No. 08/229,590, filed Apr. 19, 1994, entitled INK RIBBON CARTRIDGE now abandoned.

BACKGROUND OF THE INVENTION

1. Field of the Invention

The present invention relates generally to a printing apparatus including a printer and an ink ribbon cartridge therefor. Specifically, the present invention relates to a card printer and an ink ribbon cartridge for card printers or other such printing arrangements.

2. Description of the Related Art

Card printing arrangements have been disclosed in Japanese Patent Application (First Publication) 64-53943, for example, or, as disclosed in the article "Document Transport System" published in IBM Technical Disclosure Bulletin at col. 13, no. 6. Also, the inventor of the present invention has disclosed a card type printing arrangement in U.S. patent application Ser. No. 08/019,638.

Commonly, such printing arrangements provide an ink cartridge which may be removably attached to the printer body so as to be held adjacent thereto. FIG. 12 shows an explanatory diagram of such a conventional card printing arrangement.

Referring to the drawing, inside the cartridge casing 2, a supply reel 5 and a take-up reel 6 are rotatable mounted, having an ink ribbon 10 wound therebetween. An opening 3 is provided in the casing 2 at a position substantially centrally between the supply and take-up reels 5 and 6 for insertion of a head 29 of the printer. The head 29 in a printing position is shown by a broken line in FIG. 12. As may be seen the head 29 is inserted into the opening 3 so as to push the ink ribbon 10 downwardly to the surface 24 to be printed. As may be seen, the printer includes guide shafts 40, 40 which act together with shafts 30, 30 installed on each side of the head 29 for guiding the path of the ink ribbon 10. The ink cartridge 1 does not include any positioning means therewithin.

The guide shafts 30, 30 and 40, 40 provide the ink ribbon with a given tension determined to allow the ink ribbon to span the opening 3 while preventing the ink ribbon 10 from slackening. Also, the winding angle of the ink ribbon 10 is determined according to the positioning of the guide shafts 40, 40, which must be positioned to make the deflection of the ink ribbon over the opening as short as possible. Such a condition is satisfied by the positioning marked by the arrows A in FIG. 12. Placing the shafts in such a position A, however, hinders the speed of the printer. The reason for this is that the supply reel 5 and the take-up reel 6 are driven by driving means provided in the printer and, according to an operation of the printer, the head 29 must move in the vertical direction for pushing the ribbon cartridge down to the surface 24 to be printed. Thus, if the guide shafts 40, 40 are provided in the positions indicated by the broken likes (position A), smooth extraction of the ink ribbon 10 from the cartridge is inhibited. Thus, to prevent such a limitation and to improve printing speed, the shafts 40, 40 are placed as shown in the solid lines in FIG. 12.

However, according to such conventional placement of the guide shafts 40, 40 an overall size of the printer and cartridge becomes large and a length of an insertion stroke of the head 29 becomes large also (distance S2 in FIG. 12).

Furthermore, this necessitates that a larger volume of ink ribbon 10 be extracted per printing operation, raising the likelihood of occurrence of wrinkling and/or slackening of the ink ribbon 10 during printer operation.

Thus, it has been required to provide an ink ribbon cartridge for a printer in which a head insertion stroke may be kept small without inhibiting printing speed or operation, as well as to provide a more compact printer/cartridge combination.

SUMMARY OF THE INVENTION

It is therefore a principal object of the present invention to overcome the drawbacks of the related art.

It is a further object of the present invention to provide an ink ribbon cartridge for a printer in which a head insertion stroke may be kept small without inhibiting a printing speed or a printer operation.

It is a further object of the invention to provide a more compact printer/cartridge combination.

In order to accomplish the aforementioned and other objects, a printing apparatus for printing an image on a card-type medium is provided, comprising an ink ribbon cartridge and a printer. The ink ribbon cartridge comprises a casing including a first portion, a second portion, and a third portion to connect said first portion and said second portion and has a printer head insertion opening formed therethrough. The first portion and the second portion of the casing are offset from a center of the third portion in a first direction normal to the printer head insertion opening. A supply reel is rotatably disposed in the first portion of the casing and a take-up reel is rotatably disposed in the second portion of the casing. An ink ribbon is wound between the supply reel and the take-up reel across the printer head insertion opening. The ink ribbon has an ink surface on a first side, which is wound around the supply reel and the take-up reel so that it is positioned on an outside of the supply reel and on an outside of the take-up reel. A pair of ink ribbon guide means is mounted in the casing between the supply reel and the take-up reel so as to be slightly displaced from a plane in which rotational axes of the supply reel and the take-up reel lie and opposes the ink surface of the ink ribbon.

The printer comprises a printing stage on which the card-type medium is mounted so as to oppose the first side of the ink ribbon when the ink ribbon cartridge is accommodated in the printer and a printing head movable in a direction normal to the ink ribbon extending between the supply reel and the take-up reel. The printing head includes a pair of guide shafts mounted on either side thereof, which are substantially aligned with a tip of the printing head, and opposes a second side of the ink ribbon opposite the first side. The printing head moves along with the guide shafts in a direction normal to the ink ribbon extending between the supply reel and the take-up reel between a first position where the printing head is not in contact with the ink ribbon and a second position where the printing head is in contact with the ink ribbon. The printing head applies a tension to the ink ribbon and, during printing, pushes the second side of the ink ribbon so that the first side of the ink ribbon is in contact with the card-type medium mounted on the printing stage.

DESCRIPTION OF THE PREFERRED EMBODIMENTS

Figure 1:
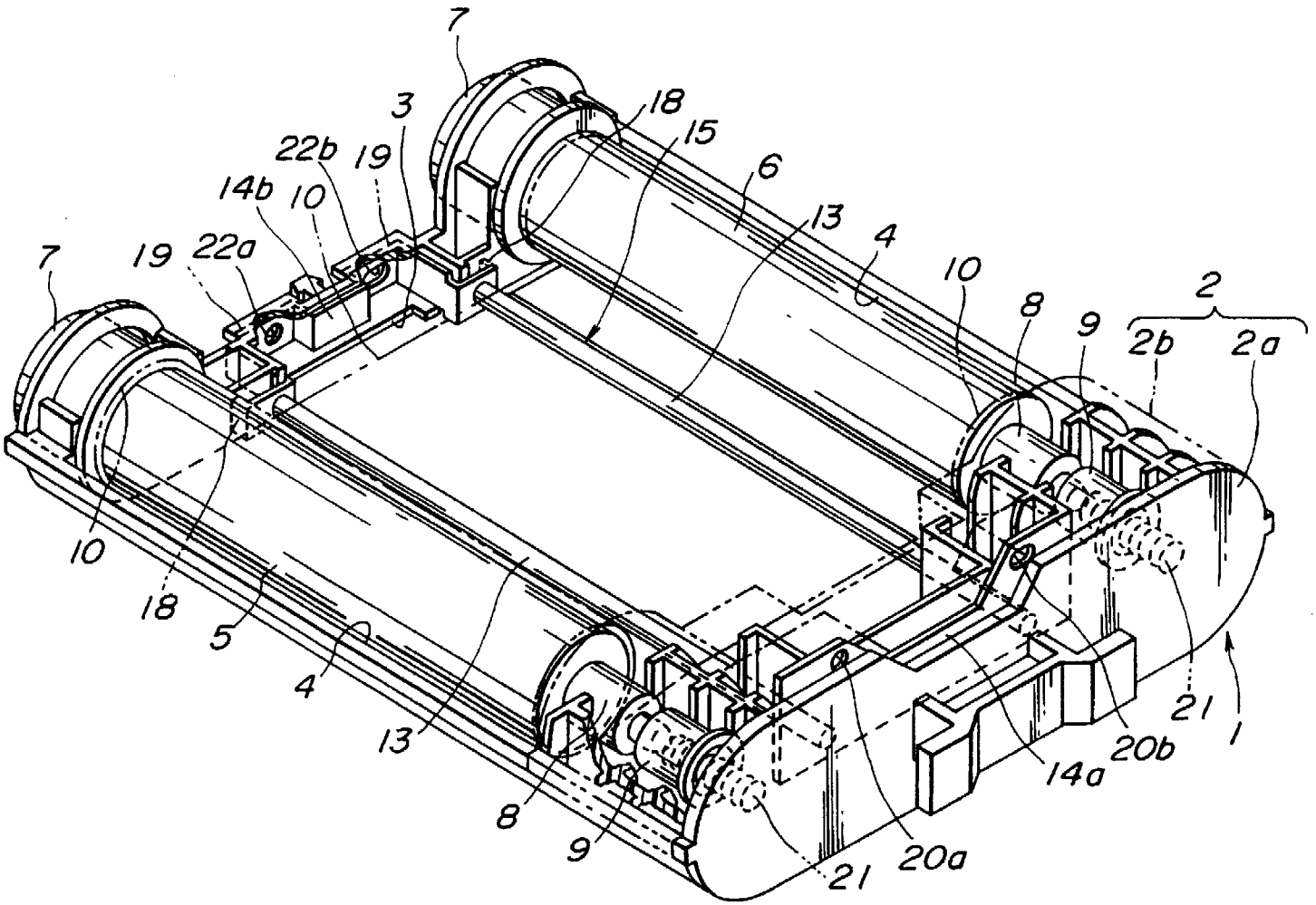
FIG. 1 is a perspective view of a lower side of an ink ribbon cartridge according to a first embodiment of the present invention.
Figure 2:
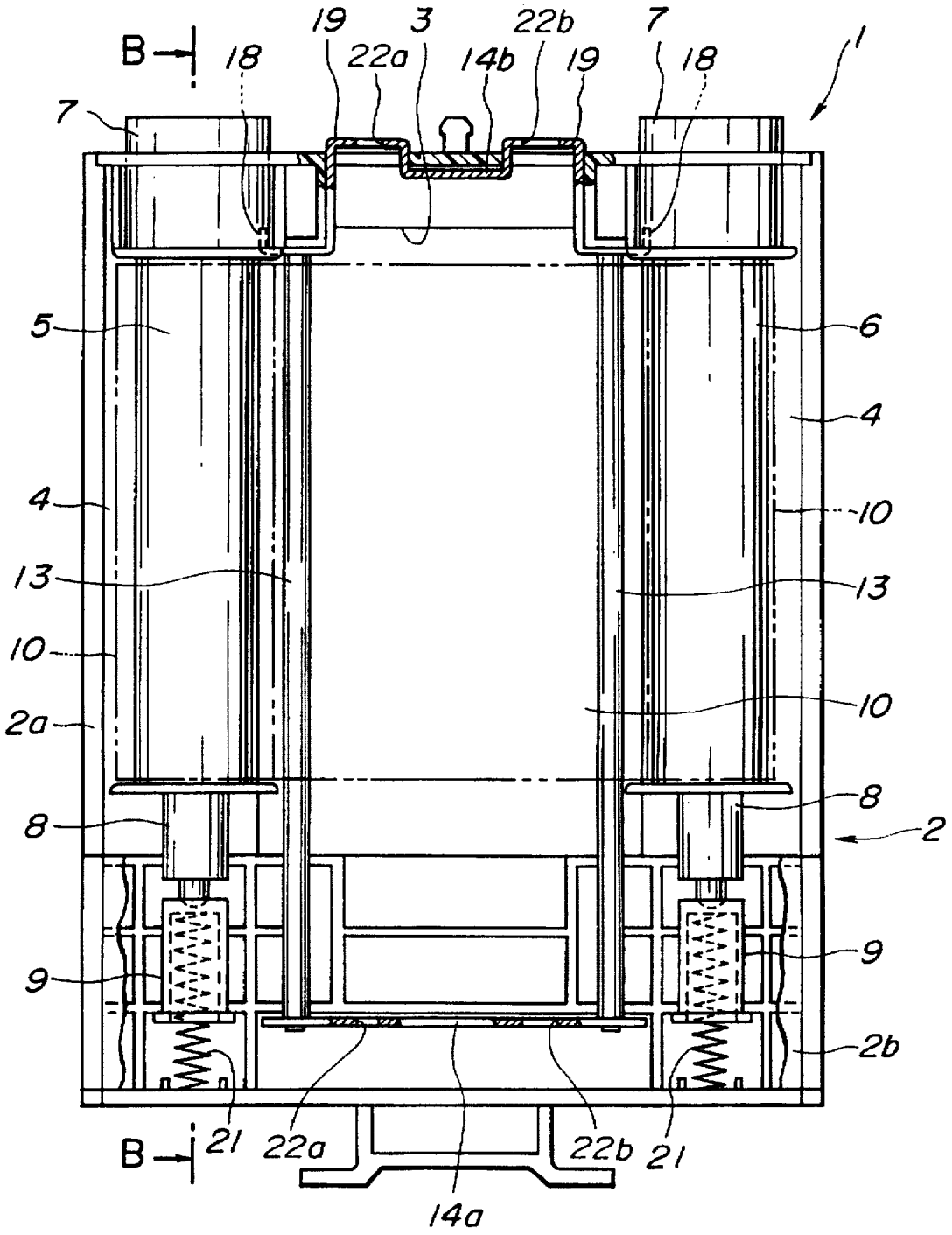
FIG. 2 is a partially cut-away plan view of the ink ribbon cartridge of FIG. 1.
Figure 3:
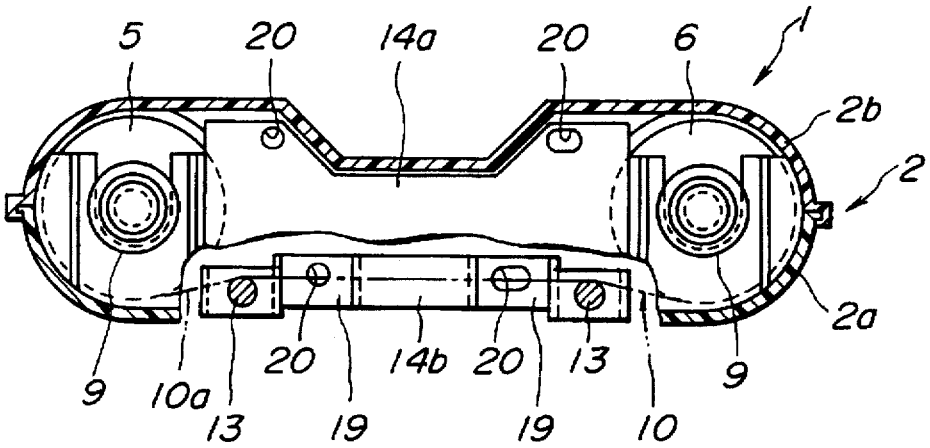
FIG. 3 is a partially cut-away side view of the ink ribbon cartridge of the first embodiment.
Figure 4:
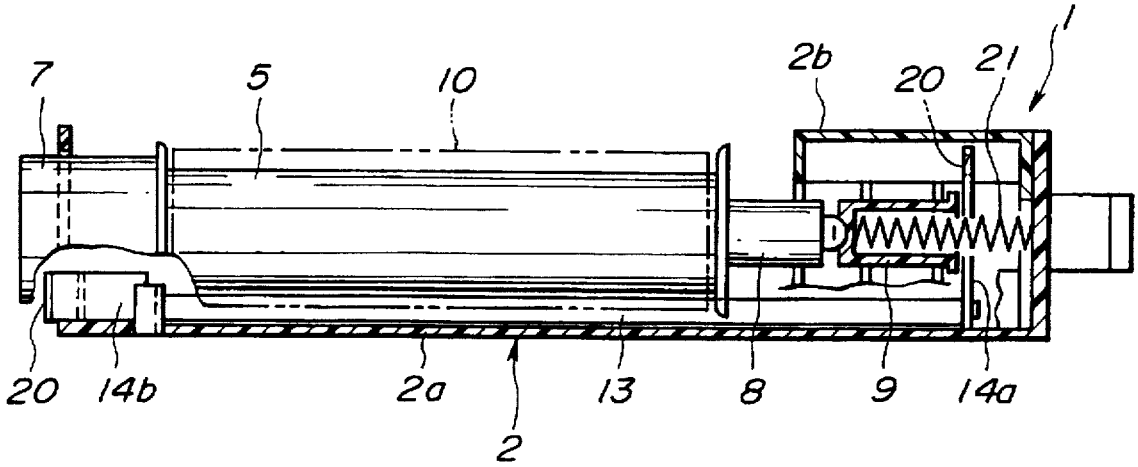
FIG. 4 is a partially cut-away longitudinal cross-sectional view of the ink ribbon cartridge shown in FIG. 3.

Referring now to the drawings, particularly to FIGS. 1 through 8, a first preferred embodiment of an ink ribbon cartridge 1 according to the invention will be described hereinbelow in detail.

The ink ribbon cartridge 1 comprises a casing 2 including a main casing 2*a* and a casing cover 2*b*, which are mutually attached at an outer peripheral edge thereof. A central portion of the casing 2 has a head insertion opening 3 defined therethrough.

On either side of the head insertion opening 3 of the casing 2, reel accommodating portions 4, 4 are formed so as to be exposed to the exterior of the casing 2. The reel accommodating portions 4, 4 respectively receive a supply reel 5 and a take-up reel 6, which are rotatably disposed therein. One end of each of the supply reel 5 and the take-up reel 6 is provided with a rotation transmission portion 7 which is projected to the outside of the casing 2. The rotation transmission portions 7, 7 are engaged by driving portions 70, 70 of the printing mechanism for transmitting a driving load thereto for controlling rotation of the reels 5, 6. Opposite the ends of the supply reel 5 and take-up reel 6 having the rotation transmission portions 7, 7, load shafts 8, 8 are respectively received by thrust mount portions 9, 9, each of which is loaded with a spring so as to apply pressure against the load shafts 8, 8 in the axial direction thereof. Thus, the supply reel 5 and the take-up reel 6 are relatively movable in the axial directions thereof and are biased in one direction by the springs 21, 21 of the thrust mount portions 9, 9.

A length of ink ribbon 10 is wound around the supply reel 5, and an end thereof is attached to the take-up reel 6 such that the ink ribbon is wound from the supply reel 5 to the take-up reel 6 while a path of travel of the ink ribbon 10 crosses the head insertion opening 3. The outer side of the ink ribbon 10 as wound on the supply reel 5 is formed with an ink surface 10*a* which may, for example, be provided with blocks of a coloring medium such as ink in yellow, magenta or cyan, for example.

Moreover, on left and right sides of the head insertion opening 3, disposed inwardly of and axially parallel to the reels 5, 6, are guide shafts 13, 13, which may be formed of metal. The path of travel of the ink ribbon 10 passing over the guide shafts 13, 13 can be seen in FIG. 7. Each end of both of the-guide shafts 13, 13 is attached to one of a pair of connecting plates 14*a*, 14*b* provided at each longitudinal end of the casing between the supply reel 5 and the take-up reel 6. The connecting plates 14*a*, 14*b* and the guide shafts 13, 13 collectively form a rigid guide assembly 15.

The rear connecting plate 14*b* is of a lower profile than the forward connecting plate 14*a* and includes hook portions 18, 18 at each end thereof for engaging grooves (not shown) provided in the casing 2 such that the rigid guide assembly 15 may be easily attached to the ink ribbon cartridge 1.

The forward connecting plate 14*a* includes positioning openings 20*a* and 20*b* defined in opposing upper sides thereof, and positioning openings 20*c* and 20*d* defined in opposing lower sides thereof. The opening 20*a* is substantially circular while the opening 20*b* is slightly elongated. Similarly, the rear side of the flexible rear connecting plate 14*b* is provided with corner portions 19, 19 having positioning openings 22*a*, 22*b* formed therebetween. According to this construction, when the ink ribbon cartridge 1 is attached to the printer 100 for carrying out a printing operation, the positioning openings 20*a*, 20*b* and 22*a*, 22*b* of the respective connecting plates 14*a* and 14*b* are engaged-by positioning pins 140*a*, 140*b* and 140*c*, 140*d*, respectively, of the printer for assuring correct positioning of the ink ribbon cartridge during operation.

Figure 5:
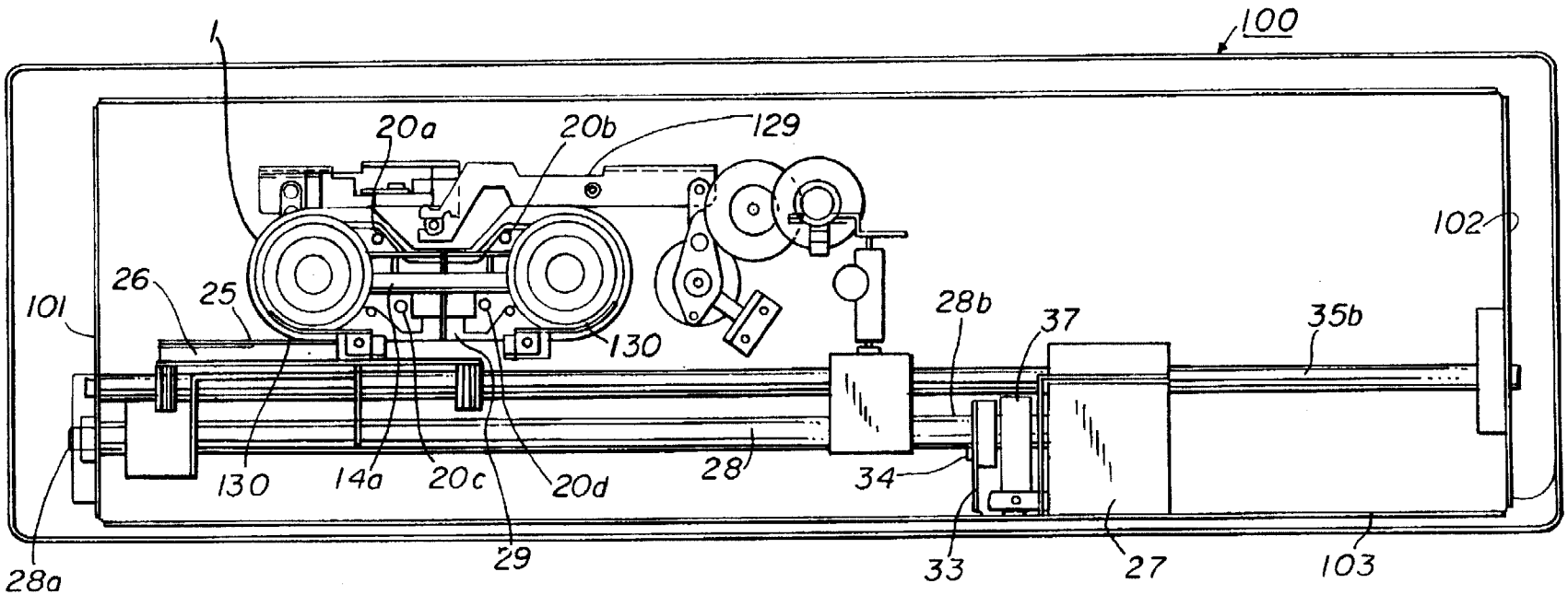
FIG. 5 is a side sectional view of the printer with the ink ribbon cartridge installed according to the present invention.
Figure 6:
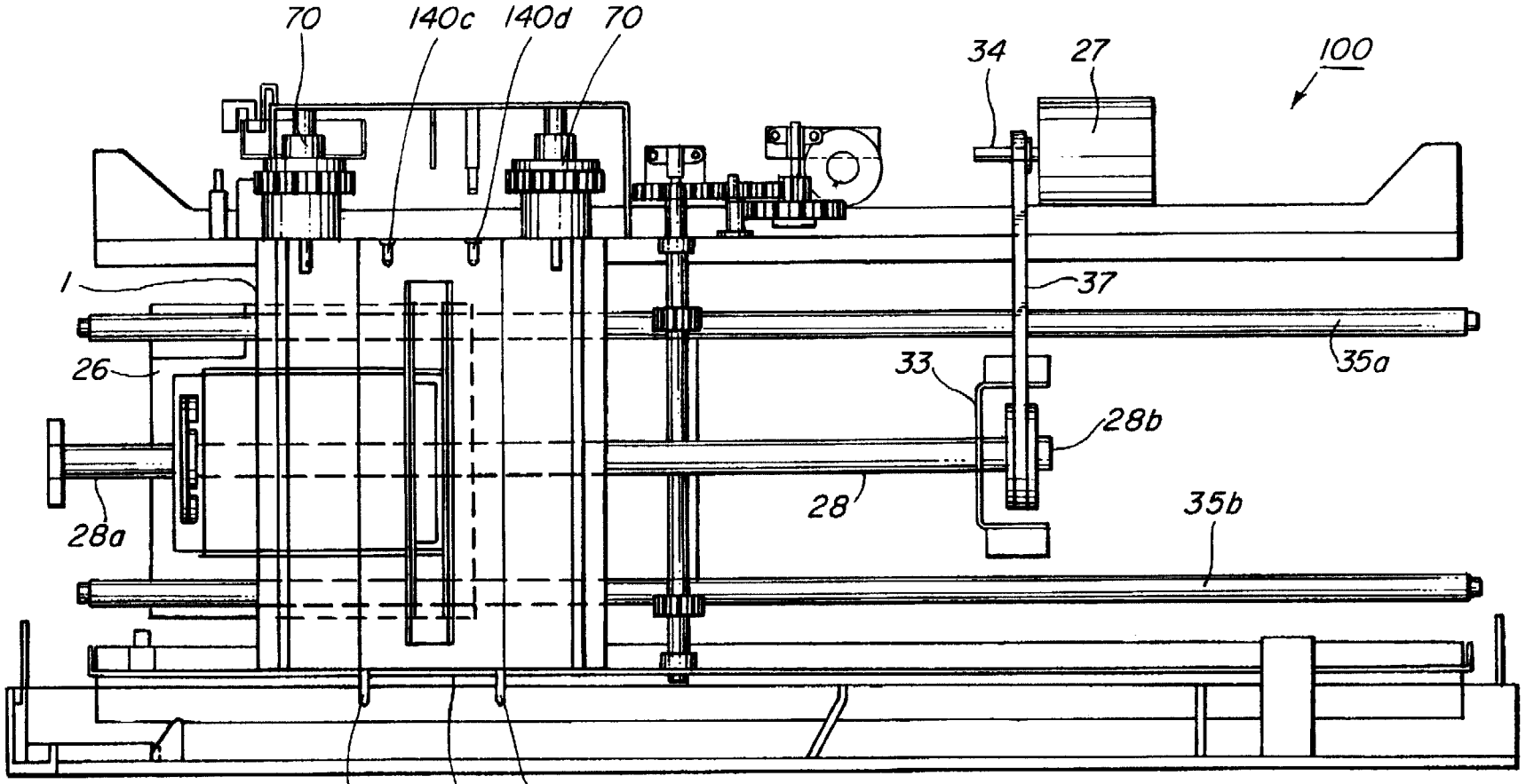
FIG. 6 is a top sectional view of the printer with the ink ribbon cartridge installed according to the present invention.
Figure 7:
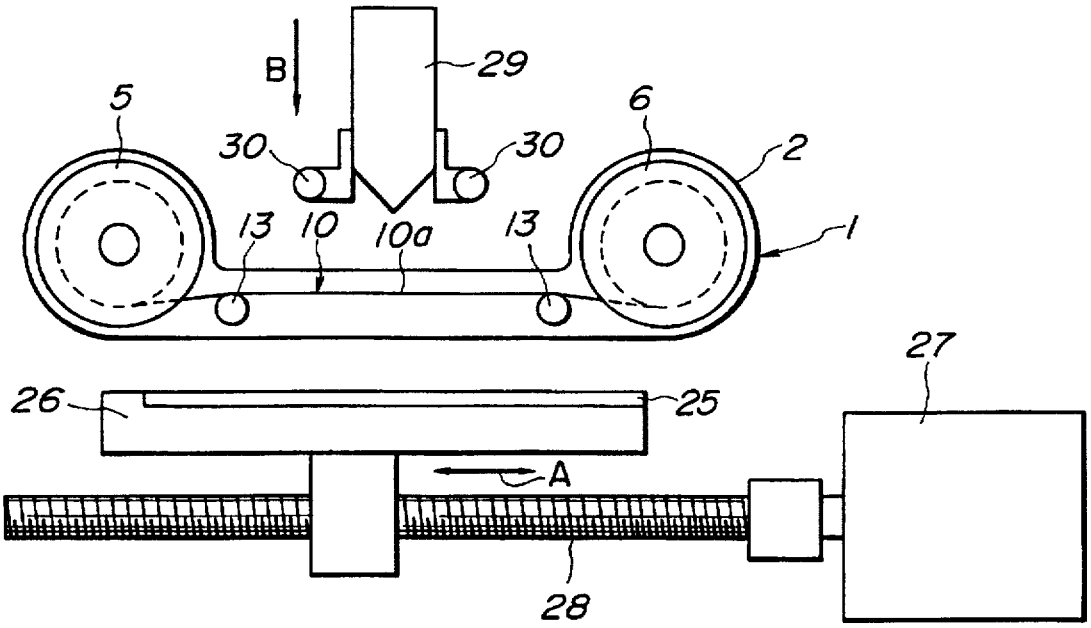
FIG. 7 is a schematic diagram of a printer set up for printing according to the first embodiment.

The construction of the printer 100 is as shown in FIGS. 5–8. As best shown in FIG. 7, a card 25 to be printed is positioned on a printing stage 26 which is mounted on a threaded drive shaft 28 rotated by a motor 27 such that the printing stage 26 is movable in the direction A indicated by the arrow in FIG. 7. As shown in FIGS. 5 and 6, the threaded shaft 28 is mounted at a first end 28*a* in the sidewall 101 of the printer 100 and at a second end 28*b* in a bracket 33 mounted on a bottom 103 of the printer 100. The second end 28*b* of the threaded shaft 28 is connected to a belt 37 that is connected to the shaft 34 of a motor 27 mounted on a bottom 103 of the printer 100. The printing stage 26 is further guided by a pair of support rods 35*a*, 35*b*, mounted in the sidewalls 101, 102 of the printer 100.

Figure 8:
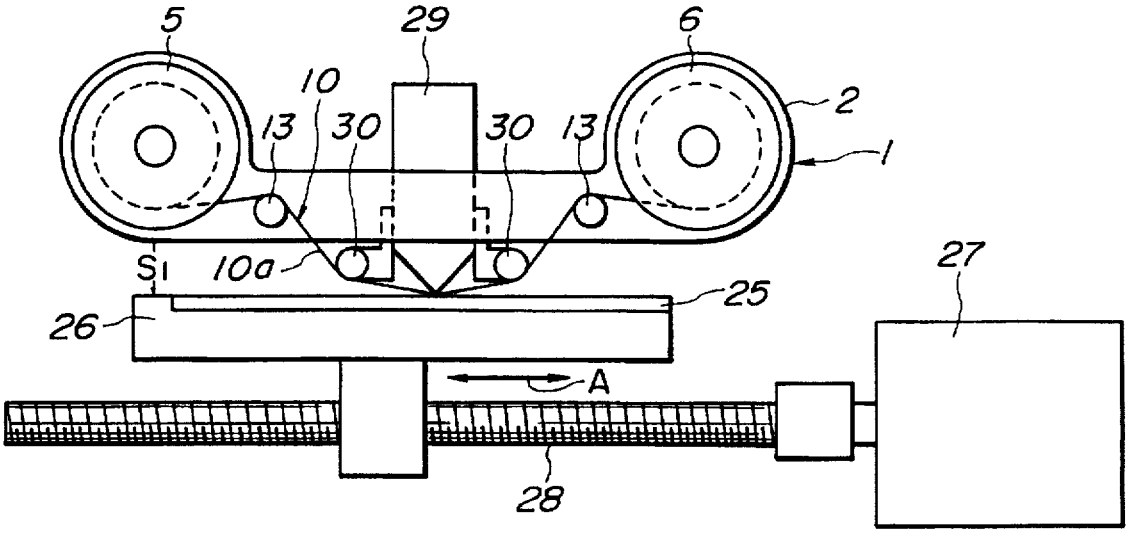
FIG. 8 is a schematic diagram of a printer executing a printing operation according to the first embodiment.

A printing head 29 is mounted on a head arm 129 which is mounted in the printer 100 over the printing stage 26. The printing head 29 includes two guide shafts 30, 30 mounted thereto at right and left sides thereof. The tip 29*a* of the printer head 29 is substantially aligned with the guide shafts 30, 30 of the printing head 29. During a printing operation the head 29 is moved from a standby position above the printing stage 26 to a printing position in which it pressingly contacts the upper surface of the card 25, with the ink ribbon 10 interposed therebetween, for effecting printing, as shown in FIG. 8. When the printing head 29 changes position, the guide shafts 30, 30 are also brought downward past the guide shafts 13, 13.

Between the printing stage 26 and the printing head 29, an ink ribbon receiving portion 130, 130 is provided for receiving the ink ribbon cartridge 1 and suitably positioning the ink ribbon 10 during printing, as shown in FIG. 5.

A printing operation utilizing the ink ribbon cartridge according to the present invention will now be described in detail, with reference to FIGS. 5–8.

As set forth above, the ink ribbon cartridge 1 is set into the ink ribbon receiving portion 130, 130 and the positioning openings 20*a*, 20*b* and 22*a*, 22*b* of the ink ribbon cartridge 1 are suitably engaged by the positioning pins 140*a*, 140*b* and 140*c*, 140*d*, respectively, of the printer 100. Further, the rotation transmission portions 7, 7 of supply reel 5 and the take-up reel 6 are engaged by driving load transmission portions 70, 70 of the printer 100 for controlling movement of the ink ribbon 10 during printing. The printing head 29 is then brought from the standby position to the printing position while the path of the ink ribbon 10 is determined by the guide shafts 13, 13 and 30, 30.

Figure 12:
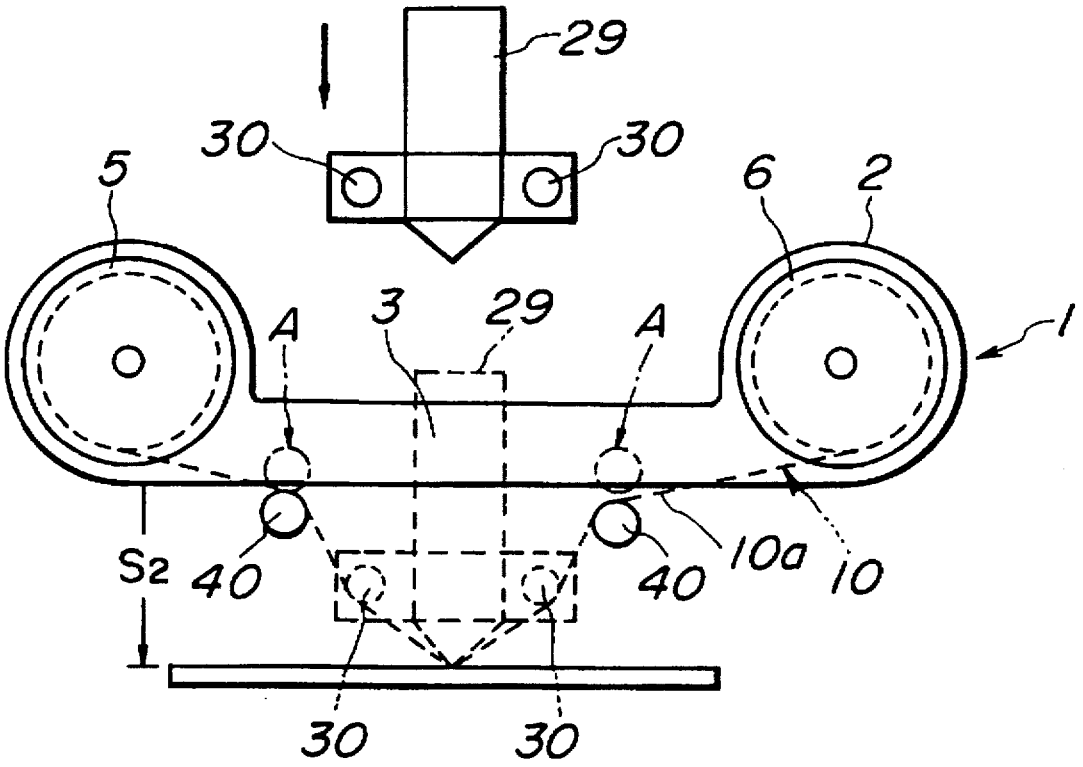
FIG. 12 (PRIOR ART)
FIG. 12 is a schematic representation of the positioning of a cartridge and printer head in a conventional card type printer.

At this point, the printing head 29 moves down through the head insertion opening 3 while the ink ribbon 10 is held in the most suitable position by the guide shafts 13, 13. As may be seen in FIG. 8, the degree of vertical displacement of the printing head 29 necessary to effect printing according to the invention (distance S1 of FIG. 8) is smaller than that required according to conventional arrangements (distance S2 of FIG. 12). Thus, according to the arrangement of the present invention, a vertical stroke of the printing head 29 may be kept as small as possible, allowing the printing arrangement to be more compact and, since the span of the head insertion opening 3, across which a length of the ink ribbon 10 always extends,.is kept as small as possible, occurrence of wrinkling, or slackening of the ink ribbon 10 is surely prevented.

Also, since the ink ribbon cartridge 1 is provided with the rigid guide portion 15 including the guide shafts 13, 13, even if the printer is subject to a relatively strong impact from the outside thereof, the positioning of the ink ribbon cartridge 1 may be reliably assured and positioning of the ink ribbon cartridge 1 relative to the printing head 29 is always correctly maintained such that a printing operation may be reliably carried out.

Figure 9:
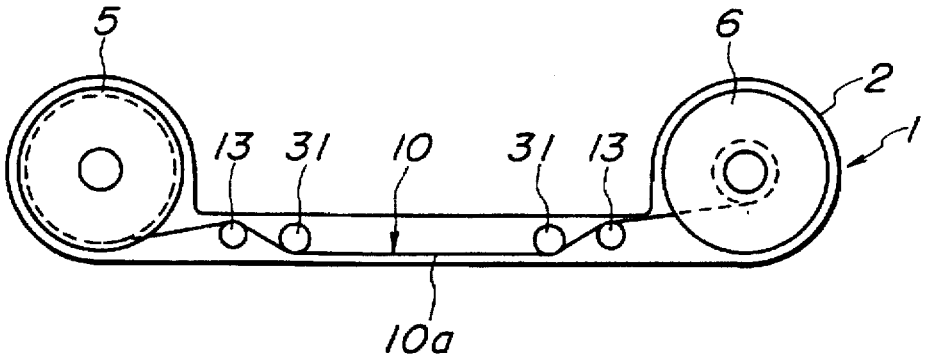
FIG. 9 is a cross-sectional view of an ink ribbon cartridge according to a second embodiment of the present invention.

FIG. 9 shows a second embodiment of an ink ribbon cartridge according to the present invention. As may be seen in the drawing, the ink ribbon cartridge 1 according to this embodiment is provided at each side of the head insertion opening 3 with a plurality of guide shafts 13, 13, 31, 31. Specifically, according to the second embodiment two guide shafts 13, 31 are provided on each side of the head insertion opening 3 respectively. According to this embodiment, the path of the ink ribbon 10 is determined such that the ink ribbon 10 passes over the first proximate guide shaft 13 and under the second guide shaft 31 so that the ink surface 10*a* of the ink ribbon 10 abuts the guide shaft 13 and the opposite surface 10*b* abuts the shaft 31. According to this construction, a span of the ink ribbon 10 across the head insertion opening 3 is further shortened. It will be noted that, as required, three or more guide shafts may be provided at each side of the head insertion opening 3. In other respects, the ink ribbon cartridge 1 according to the second embodiment is identical in construction and operation to the above-described first embodiment.

Figure 10:
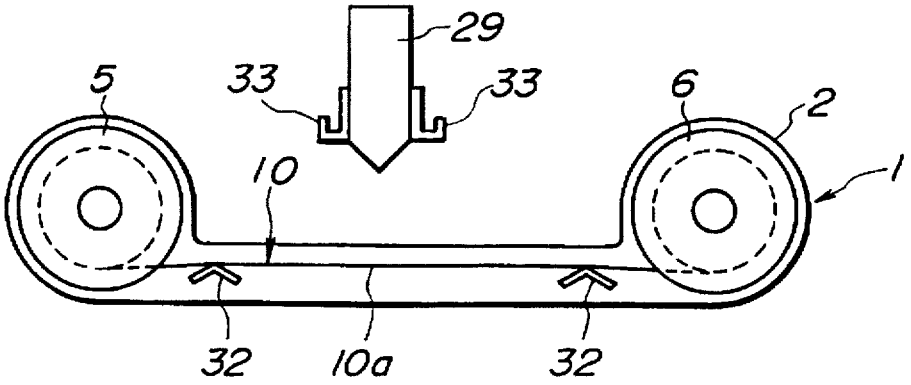
FIG. 10 is a cross-sectional view of an ink ribbon cartridge and printing head arrangement according to a third embodiment of the present invention.

FIG. 10 shows a third embodiment of an ink ribbon cartridge according to the invention. As may be seen the ink ribbon cartridge 1 according to this embodiment is provided at each side of the head insertion opening 3 with a guide member 32 which may, for example, have an arrow-shaped cross section and which abuts an ink surface 10*a* of the ink ribbon 10. In addition, a printing head 29 may be equipped with L-shaped guide plates 33, 33 at either side of, but recessed in relation to, the tip 29*a*. According to this arrangement the same advantages as those of the above-described first embodiment are obtained while manufacturing costs are reduced. In other respects, the ink ribbon cartridge 1 according to the third embodiment is identical in construction and operation to the above-described first embodiment.

Figure 11:
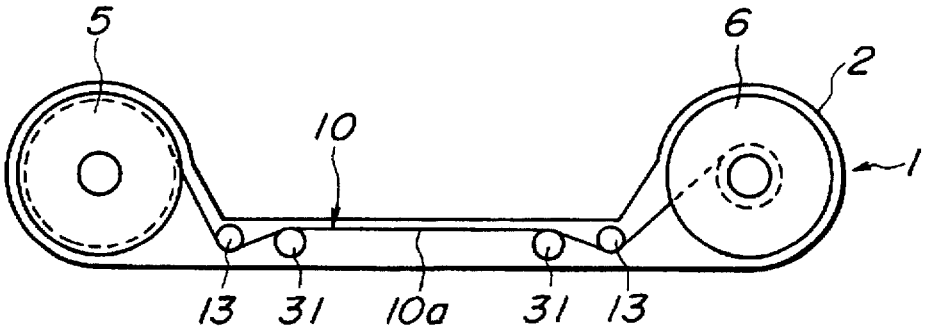
FIG. 11 is a cross-sectional view of an ink ribbon cartridge according to a fourth embodiment of the present invention.

FIG. 11 shows a fourth embodiment of an ink ribbon cartridge according to the present invention. As may be seen, the fourth embodiment includes, at each side of the head insertion opening 3 a plurality of guide shafts 13, 13, 31, 31 similar to those of the above-described second embodiment. Specifically, according to the fourth embodiment two guide shafts 13, 31 are provided on each side of the head insertion opening 3 respectively. Although, unlike the second embodiment, according to the present embodiment, the path of the ink ribbon 10 is determined such that the ink ribbon 10 is disposed under the first proximate guide shaft 13 and over the second guide shaft 31 so that the ink surface 10*a* of the ink ribbon 10 abuts the guide shaft 31 and the opposite surface 10*b* abuts the shaft 13. Thus, tensioning of the ink ribbon 10 is different from the second embodiment and a span of the ink ribbon 10 over the head insertion opening 3 may be shortened. In addition, the ink surface 10*a* of the ink ribbon 10 is offered additional protection. In other respects, the ink ribbon cartridge 1 according to the fourth embodiment is identical in construction and operation to the above-described embodiments.

While the present invention has been disclosed in terms of the preferred embodiments in order to facilitate a better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

What is claimed is:

1. A printing apparatus for printing an image on a card-type medium comprising:

a printer; and an ink ribbon cartridge mounted in said printer, said ink ribbon cartridge comprising:

a casing supported in said printer including a first portion, a second portion, and a third portion to connect said first portion and said second portion and having a printer head insertion opening formed therethrough, said first portion and said second portion being offset from a center of said third portion in a first direction normal to said printer head insertion opening;

a supply reel rotatably disposed in said first portion of said casing;

a take-up reel rotatably disposed in said second portion of said casing;

an ink ribbon wound between said supply reel and said take-up reel across said printer head insertion opening, said ink ribbon having an ink surface on a first side, said first side of said ink ribbon being wound around said supply reel and said take-up reel so that said first side of said ink ribbon is positioned on an outside of said supply reel and on an outside of said take-up reel; and a pair of ink ribbon guide means mounted in said casing between said supply reel and said take-up reel so as to be slightly displaced from a plane in which rotational axes of said supply reel and said take-up reel lie and opposing said ink surface of said ink ribbon;

and said printer comprising:

a printing stage movably mounted on said printer, wherein a card-type medium is mounted on said printing stage so as to oppose said first side of said ink ribbon when said ink ribbon cartridge is accommodated in said printer;

a printing head movably mounted in said printer for movement in a direction normal to said ink ribbon extending between said supply reel and said take-up reel, said ink ribbon of said ink ribbon cartridge being disposed between said printing stage and said printing head, wherein said printing head includes a pair of guide shafts mounted on either side thereof, said pair of guide shafts being substantially aligned with a tip of said printing head, said printing head opposing a second side of said ink ribbon opposite said first side and being operative to move between a first position where said printing head is not in contact with said ink ribbon and a second position where said printing head is in contact with said ink ribbon to apply a tension to said ink ribbon so that, during printing, said printing head pushes said second side of said ink ribbon so that the first side of said ink ribbon is in contact with said card-type medium mounted on said printing stage; and a pair of connecting plates, wherein one of said pair of connecting plates is disposed on a first side of said printer head insertion opening and another of said pair of connecting plates is disposed on a second side of said printer head insertion opening opposite said first side, and wherein said pair of ink ribbon guide means extend between said pair of connecting plates.

2. A printing apparatus as set forth in claim 1, wherein each of said pair of guide means has a pair of opposed ends, each of said pair of opposed ends being attached to one of said pair of connecting plates.

3. A printing apparatus as set forth in claim 2, wherein said pair of connecting plates are made of metal.

4. A printing apparatus as set forth in claim 2, further comprising a plurality of positioning pins mounted in said printer wherein said means for securing comprises a plurality of positioning openings formed in each of said pair of connecting plates for engagement with said plurality of positioning pins.

5. A printing apparatus as set forth in claim 1, wherein each of said pair of ink ribbon guide means comprises first and second guide members which are arranged adjacent to one of said supply reel and said take-up reel such that said first guide member is disposed between said second guide member and said adjacent one reel.

6. A printing apparatus as set forth in claim 5, wherein said first guide member supports said ink surface of said ink ribbon and said second guide member supports said second side of said ink ribbon opposite said ink surface.

7. A printing apparatus as set forth in claim 5, wherein said first and second guide members of each of said pair of ink ribbon guide means are arranged adjacent to each other and spaced from each other in a direction of travel of said ink ribbon between said supply reel and said take-up reel.

8. A printing apparatus as set forth in claim 7, wherein each of said first and second guide members of each of said pair of ink ribbon guide means has a circular cross-section.

9. A printing apparatus as set forth in claim 5, wherein one of said pair of connecting plates is disposed on a first side of said printer head insertion opening and another of said pair of connecting plates is disposed on a second side of said printer head insertion opening opposite said first side, said first and second guide members of each of said pair of guide means extend between said pair of connecting plates, and ends of each of said first and second guide members of each of said pair of guide means are attached to said pair of connecting plates.

10. A printing apparatus as set forth in claim 9, further comprising a plurality of positioning pins mounted in said printer wherein said means for securing comprises a plurality of positioning openings formed in each of said pair of connecting plates for engagement with said plurality of positioning pins.

11. A printing apparatus as set forth in claim 1, wherein each of said pair of ink ribbon guide means comprises a guide member which is arranged to support said ink surface.

12. A printing apparatus as set forth in claim 11, wherein said guide member of each of said pair of ink ribbon guide means has an inverted V-shaped cross-section.

13. A printing apparatus as set forth in claim 11, wherein said guide member comprises an elongated shaft having an axis parallel to an axis of said supply reel and of said take-up reel.

14. A printing apparatus as set forth in claim 1, further comprising a threaded drive shaft rotatably mounted on said printer for supporting and driving said printing stage.

15. A printing apparatus as set forth in claim 14, further comprising a pair of support rods fixedly mounted on said printer for stably guiding said printing stages.

16. A printing apparatus for printing an image on a card-type medium comprising:

a printer; and an ink ribbon cartridge mounted in said printer, said ink ribbon cartridge comprising:

a casing supported in said printer including a first portion, a second portion, and a third portion to connect said first portion and said second portion and having a printer head insertion opening formed therethrough, said first portion and said second portion being offset from a center of said third portion in a first direction normal to said printer head insertion opening;

a supply reel rotatably disposed in said first portion of said casing;

a take-up reel rotatably disposed in said second portion of said casing;

an ink ribbon wound between said supply reel and said take-up reel across said printer head insertion opening, said ink ribbon having a first side and a second side with an ink surface applied on a first side, said ink ribbon being wound around said supply reel and said take-up reel so that said second side of said ink ribbon is positioned on an outside of said supply reel and on an outside of said take-up reel; and a pair of ink ribbon guide means mounted in said casing between said supply reel and said take-up reel so as to be slightly displaced from a plane in which rotational axes of said supply reel and said take-up reel lie and opposing said ink surface of said ink ribbon;

and said printer comprising:

a printing stage movably mounted on said printer, wherein a card-type medium is mounted on said printing stage so as to oppose said first side of said ink ribbon when said ink ribbon cartridge is accommodated in said printer;

a printing head movably mounted in said printer for movement in a direction normal to said ink ribbon extending between said supply reel and said take-up reel, said ink ribbon of said ink ribbon cartridge being disposed between said printing stage and said printing head, wherein said printing head includes a pair of guide shafts mounted on either side thereof, said pair of guide shafts being substantially aligned with a tip of said printing head, said printing head opposing said second side of said ink ribbon opposite said first side and being operative to move between a first position where said printing head is not in contact with said ink ribbon and a second position where said printing head is in contact with said ink ribbon to apply a tension to said ink ribbon so that, during printing, said printing head pushes said second side of said ink ribbon so that the first side of said ink ribbon is in contact with said card-type medium mounted on said printing stage; and a pair of connecting plates, wherein one of said pair of connecting plates is disposed on a first side of said printer head insertion opening and another of said pair of connecting plates is disposed on a second side of said printer head insertion opening opposite said first side, and wherein said pair of ink ribbon guide mans extend between said pair of connecting plates and each of said pair of guide means comprises first and second guide members arranged adjacent to one of said supply reel and said take-up reel such that said first guide member is disposed between said second guide member and said adjacent one reel, and wherein said first guide member supports said ink ribbon on said second side of said ink ribbon opposite said ink surface and said second guide member supports said ink surface.

* * * * *